US005400830A

United States Patent [19]

Stiles et al.

[11] Patent Number: 5,400,830

[45] Date of Patent: Mar. 28, 1995

[54] COMPOSITE AUTOMOTIVE EXHAUST PIPE

[75] Inventors: Ernest D. Stiles, St. Clair Shores; Dale L. Hartsock, Livonia, both of Mich.

[73] Assignee: Ford Motor Company, Dearborn, Mich.

[21] Appl. No.: 974,638

[22] Filed: Nov. 12, 1992

[51] Int. Cl.[6] ..... F01N 7/14; F01N 7/18

[52] U.S. Cl. ..... 138/149; 138/110; 29/890.08

[58] Field of Search ..... 138/149, 110–114, 138/104, 148, 140; 60/272, 274, 299, 323; 29/890.08, 890.036

[56] References Cited

U.S. PATENT DOCUMENTS

| | | | |
|---|---|---|---|
| 3,181,646 | 5/1965 | Edwards | 181/248 |
| 3,233,699 | 2/1966 | Plummer | 138/147 |
| 4,194,536 | 3/1980 | Stine et al. | 138/149 |
| 4,239,091 | 12/1980 | Negrao | 181/243 |
| 4,345,430 | 8/1982 | Pallo et al. | 138/149 |
| 4,350,223 | 9/1982 | Takai | 181/229 |
| 4,397,338 | 8/1983 | Cunningham | 138/145 |
| 4,478,253 | 10/1984 | Everett | 138/140 |
| 4,539,055 | 9/1985 | Orcutt | 138/149 X |
| 4,590,971 | 5/1986 | Webster et al. | 138/149 |
| 4,653,541 | 3/1987 | Oehlschlaeger et al. | 138/104 |
| 4,700,751 | 10/1987 | Fedrick | 138/149 |
| 4,744,842 | 5/1988 | Webster et al. | 138/149 X |
| 4,942,903 | 7/1990 | Jacobsen | 138/110 |
| 5,020,481 | 6/1991 | Nelson | 138/149 |
| 5,092,122 | 3/1992 | Bainbridge | 138/149 |
| 5,163,289 | 11/1992 | Bainbridge | 138/149 |

*Primary Examiner*—David A. Scherbel
*Assistant Examiner*—Patrick F. Brinson
*Attorney, Agent, or Firm*—Lorraine S. Melotik; Roger L. May

[57] ABSTRACT

This invention is directed to a composite pipe comprising three layers adjacent to one another. It consists of a thin-walled metallic inner liner, a thermally insulating ceramic material layer, and an outer casing of a non-metallic material. The composite pipe is useful in automotive applications such as exhaust gas systems to reduce the thermal energy transfer from the exhaust pipe along the length of the pipe, reduce sound transmission, hinder corrosion and reduce weight.

6 Claims, 1 Drawing Sheet

COMPOSITE AUTOMOTIVE EXHAUST PIPE

FIELD OF THE INVENTION

This invention relates in general to an automotive exhaust pipe, and in particular to a composite pipe having low thermal losses.

BACKGROUND OF THE INVENTION

Automobile engine exhaust systems have traditionally relied on pipes made completely of metal to provide passage of the spent exhaust gases from the engine compartment to the rear of the vehicle, where the gases are released to the atmosphere. Although this method of exhausting gases is effective, considerable thermal energy is given off by conduction through the metal exhaust pipe wall, resulting in the need to protect sensitive components near the pipe from the connected and radiated heat. In addition, conventional metal exhaust pipes are subject to corrosion due to chemical and physical attack in the use environment.

The fabrication of a composite pipe with a layer of insulating material to reduce thermal energy transfer between a thin-walled inner metal tube and an outer non-metal casing would alleviate, or even eliminate, the above-mentioned disadvantages. It would reduce the need for vehicle heat shields and allow design flexibility with respect to heat sensitive materials and components located near the pipe. The thermal load on a vehicle's air conditioning unit would be lessened by reducing the underbody heat. Additionally, since the composite pipe would transfer less heat, it would desirably provide the heat sooner to the catalyst in the catalytic converter causing faster light off, thus improving catalytic efficiency. By maintaining the exhaust gas temperature and resultant gas velocity, a scavenging action of the cylinders is improved, which in turn contributes to overall engine efficiency. The composite pipe also would have extended durability and .improved NVH characteristics as well as the advantage of possible weight reduction.

SUMMARY OF THE INVENTION

This invention is directed to an automotive type exhaust pipe which is a composite consisting of a solid thin-walled metallic tubular inner liner for carrying automotive exhaust gases, a thermally insulating ceramic material layer around the outer surface to the tubular inner liner, which layer is carried substantially along the entire length of the tubular inner liner, and a rigid non-metallic outer casing enclosing the thermally insulating ceramic material layer to protect it from chemical and physical attack in an automotive use environment. The ceramic material layer constitutes a barrier means to the thermal energy of any exhaust gases within the tubular inner liner.

DESCRIPTION OF PREFERRED EMBODIMENTS

Figure 1:
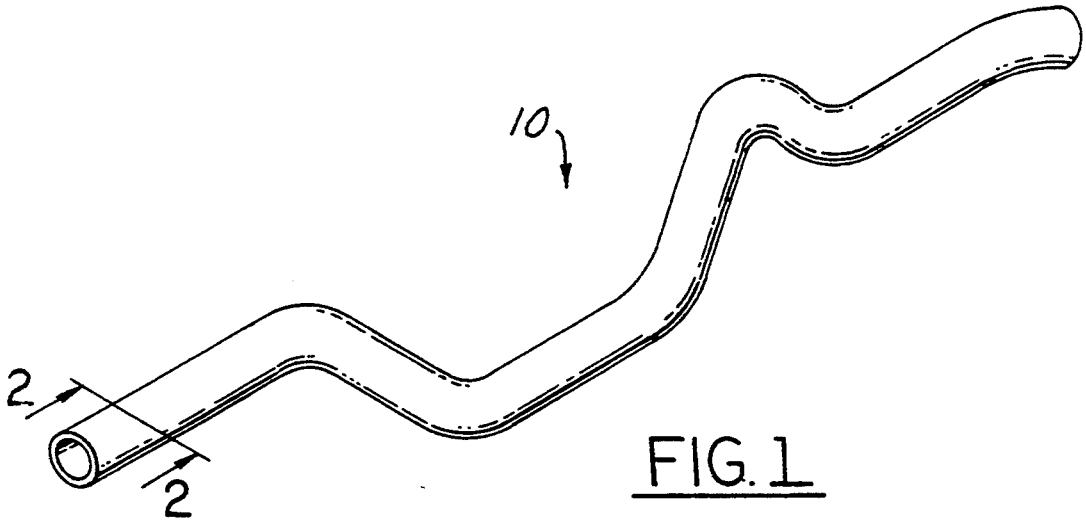
FIG. 1 is a perspective view of a composite pipe according to an embodiment of the invention.

FIG. 1 illustrates a composite pipe 10 for carrying exhaust gases from an automotive type engine. It will become clear, however, that the invention could be applied equally to other high temperature gas systems.

Figure 2:
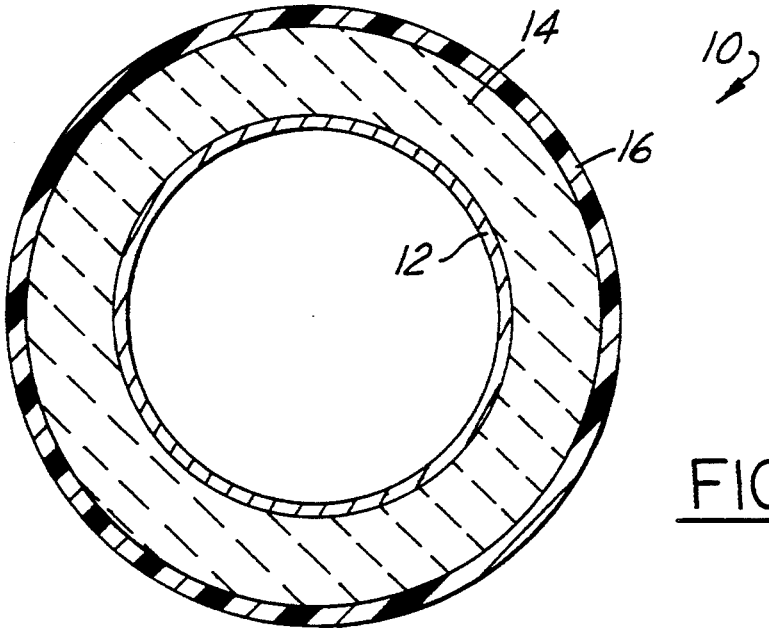
FIG. 2 is a cross-sectional view taken on a plane perpendicular to the axis of the composite pipe through line 2—2 of FIG. 1.

FIG. 2 shows a cross-sectional view of composite pipe 10 taken along a plane perpendicular to the axis of the pipe. The composite pipe 10 in this case is a composite of three layers. The inner liner 12 is tubular and made of metal. It is thin-walled, the wall thickness preferably between about 0.030 inches and 0.060 inches thick. The metal liner would be a typical tube steel such as stainless steel. A layer 14 of highly effective thermal insulation would surround the metal liner and act as a barrier means to contain the thermal energy of any gases carried in the tubular liner. It would comprise a ceramic material, that is selected from ceramic oxides in forms such as foam, powder, or hollow spheres. Herein, as would be appreciated by those skilled in the art, ceramics. are meant to include inorganic materials like silicates, titanates, oxides, and minerals such as kaolin,, igneous basalt, or perlite rock. The thermally insulating ceramic material would be porous in nature and could additionally include materials like alumina, zirconia, and silica. Numerous thermally insulating porous materials as disclosed above are known to those skilled in the art. Exemplary materials include NEXTEL ceramic fiber (trademark, 3M Co.), "Fiberfax" ceramic fiber (trademark, Carborundum Co.), RETCEL ceramic foam (trademark, HiTech Inc.) and WDS ceramic powder (trademark, Wacker Co.). The ceramic insulating layer would be of a wall thickness greater than that of the metallic inner liner. Preferably, it would be of a thickness between about 0.1 and 0.5 inch. The thickness would depend on the heat range and particular insulating qualities of the material and the level of heat containment desired.

The thermally insulating ceramic material layer is enclosed by a rigid non-metallic outer casing 16 along its length to protect the ceramic material layer from chemical and physical attack in its intended use environment. Exemplary of materials suitable for the casing are high temperature thermal set or thermoplastic materials, including, but not limited to high temperature phenolic resins; epoxy materials like EPON 820 (trademark, Shell Chemical Co.); like RYTON (trademark, Philips Petroleum Co.); and like ULTEMP (trademark, General Electric Co.). Although the gases in an automobile exhaust system pipe according to the invention may reach 1700° F. during operation of the automobile, the casing material need only be stable to about 500°-600° F. due to the thermal insulation provided by the ceramic layer. The casing 16 would be of wall thickness which will provide suitable protection to the ceramic layer and provide rigidity to the composite pipe. Generally this would be between about 0.06 and 0.18 inch.

.The composite pipe according to the disclosed invention can be made in various ways. For example, a metallic tubular inner liner could be wrapped with thermal insulation and then a casing extruded or molded over the insulation. Alternately, a casing could be molded first, a smaller diameter inner metallic liner provided within the casing, and subsequently a thermally insulating ceramic layer could be formed in place by injecting an uncured insulating material, e.g., an uncured ceramic foam, between the liner and casing and then curing this material. According to this technique, the metal inner liner and the outer non-metallic casing could be formed simultaneously while maintaining a uniform space therebetween for insertion of an insulation layer. According to still another process for making the invention, the insulation and casing could be co-extruded around the metal inner liner and then cured.

It will be clear from the above that the inner liner will prevent contact of the gases with the insulating material which is generally porous. The insulating layer being of greater walled dimension than the thin-walled liner can provide rigidity to the composite pipe in addition to reducing thermal energy transfer from the liner. Since the composite pipe will reduce heat transfer, it will desirably provide the heat sooner to the catalyst in the catalytic converter. This will result in faster light off of the catalyst, thus improving catalytic efficiency. It will also keep the catalyst above light off temperature during transients and short shut downs. The insulating layer in combination with the outer casing will reduce corrosive problems, provide durability, and also reduce to a minimum the transmission of sound occasioned by the travel of gases through the liner 12. Further, the combination of the thin-walled inner liner, ceramic insulating layer and outer non-metallic casing will provide a composite pipe which has reduced weight compared to a conventional metallic exhaust pipe with required heat shielding.

We claim:

1. A method of fabricating a composite automotive type exhaust pipe, comprising the steps of:

providing a solid thin-walled metallic tubular inner liner within a rigid molded non-metallic outer casing of greater diameter and substantially the same length and forming a generally annular space therebetween; and subsequently forming a thermally insulating ceramic material layer therebetween by placing an uncured composition of said material in said annular space and curing same, said layer constituting a barrier means to the thermal energy of any exhaust gases within said tubular inner liner.

2. The method as in claim 1, wherein said tubular inner liner is steel.

3. The method as in claim 2, wherein said steel is stainless steel.

4. The method as in claim 1, wherein said ceramic material is selected from the group consisting of ceramic foam, ceramic powder, and ceramic fiber.

5. The method as in claim 1, wherein said outer casing is a high temperature stable thermal set or thermoplastic material.

6. The method as in claim 1, wherein said metal inner liner and said out non-metallic casing are formed simultaneously while maintaining a uniform space therebetween for subsequent insertion of said insulating material layer.

* * * * *